US008007880B2

(12) United States Patent
Ullmann

(10) Patent No.: US 8,007,880 B2
(45) Date of Patent: Aug. 30, 2011

(54) INSERT FOR A PRESSURIZED CONTAINER OF LIQUID

(75) Inventor: Bernd Ullmann, Bonn (DE)

(73) Assignee: Ball Packaging Europe GmbH, Ratingen (DE)

( * ) Notice: Subject to any disclaimer, the term of this patent is extended or adjusted under 35 U.S.C. 154(b) by 1137 days.

(21) Appl. No.: 10/538,261

(22) PCT Filed: Dec. 5, 2003

(86) PCT No.: PCT/EP03/13779
§ 371 (c)(1),
(2), (4) Date: Dec. 9, 2005

(87) PCT Pub. No.: WO2004/054896
PCT Pub. Date: Jul. 1, 2004

(65) Prior Publication Data

US 2006/0153956 A1 Jul. 13, 2006

(30) Foreign Application Priority Data

Dec. 16, 2002 (DE) ..... 102 58 791

(51) Int. Cl.
*B29D 22/00* (2006.01)
*B65B 25/06* (2006.01)
*B65B 31/02* (2006.01)

(52) U.S. Cl. ..... 428/34.1; 426/397; 53/432

(58) Field of Classification Search ..... 428/34.1; 426/106, 397; 53/432; 220/501, 553
See application file for complete search history.

(56) References Cited

U.S. PATENT DOCUMENTS 1,567,050 A * 12/1925 Grieshaber et al. ..... 114/333
(Continued)

FOREIGN PATENT DOCUMENTS

CA 2380030 10/2002
(Continued)

OTHER PUBLICATIONS

International Search Report for International (PCT) Application No. PCT/EP2005/006955, dated Dec. 23, 2005.

*Primary Examiner* — Rena L Dye
*Assistant Examiner* — James Yager
(74) *Attorney, Agent, or Firm* — Sheridan Ross P.C.

(57) ABSTRACT

The invention relates to an insert that is to be added to a gas-pressurized liquid in a container. Said insert comprises a pressure-activated body with at least one cavity, said body being connected to a positioning device. According to the invention, (a) the pressure-activated body (4) comprises at least one opening (10) with a reduced diameter, which connects the cavity to the environment of the insert and is situated in a location that lies above the level of liquid when the insert is floating on said liquid and (b) the positioning device comprises a floating body (1, 2; 1, 2, 6) with a small opening (3), which is submerged in the liquid when the insert is placed on the latter, a ventilation opening (5), which communicates directly with the external environment (14) of the insert and a minimum volume (11), which when filled with liquid enables the insert to sink into the liquid. The inventive insert can be added to liquids that are sealed under pressure. It floats to the surface of said liquid, but sinks after a period of time. Its pressure-activated body is charged with the internal pressure of the sealed container and when the container of liquid is opened, said pressure is used in a known manner to achieve effects such as an improved foaming of beer or to mix a substance, which up to the point of opening has been stored separately in the container, with the liquid.

20 Claims, 5 Drawing Sheets

U.S. PATENT DOCUMENTS

Figure 1:
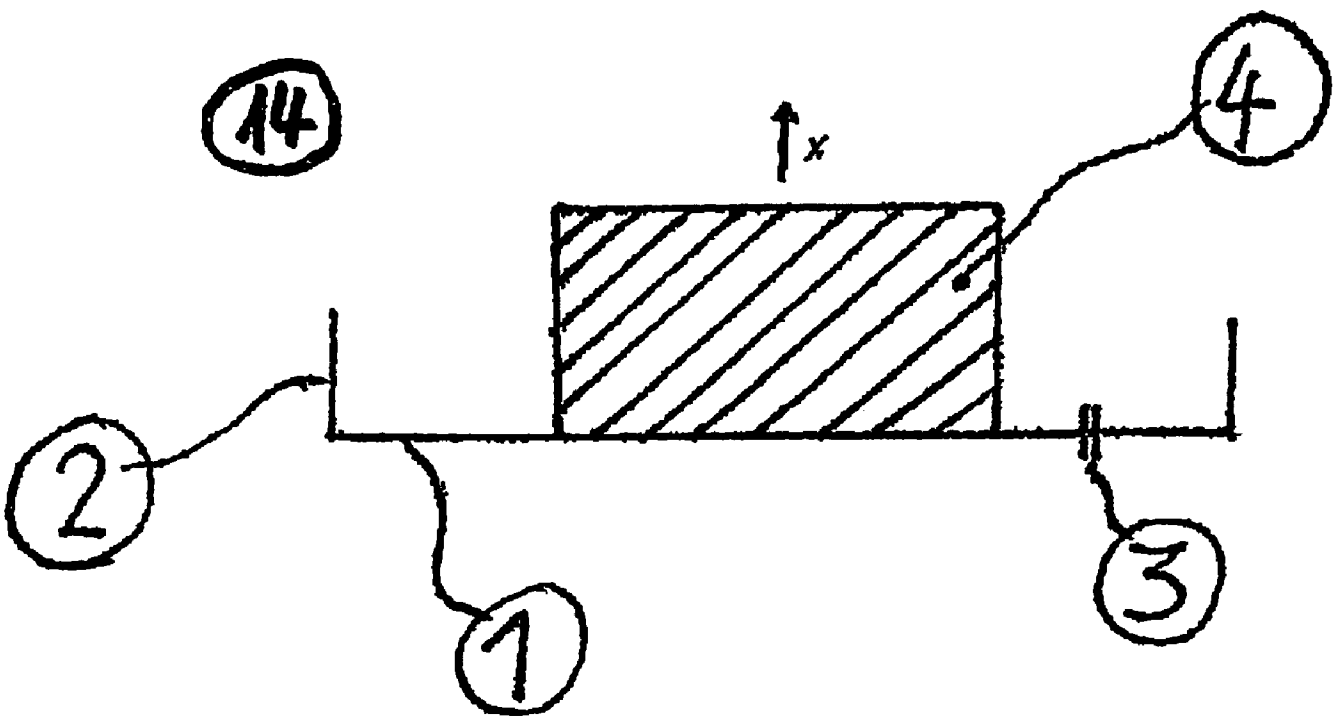

| | | | | |
|---|---|---|---|---|
| 3,144,020 | A | | 8/1964 | Zingale et al. |
| 3,449,134 | A | | 6/1969 | Leasure et al. |
| 4,627,986 | A | | 12/1986 | Bardsley et al. |
| 5,405,344 | A | | 4/1995 | Williamson et al. |
| 5,441,494 | A | | 8/1995 | Ortiz |
| 5,454,827 | A | | 10/1995 | Aust et al. |
| 5,522,788 | A | | 6/1996 | Kuzmak |
| 5,683,732 | A | | 11/1997 | Baxter et al. |
| 5,704,898 | A | | 1/1998 | Kokish |
| 5,705,209 | A | * | 1/1998 | Wright et al. ..... 426/112 |
| 5,714,186 | A | * | 2/1998 | Nash et al. ..... 426/106 |
| 5,807,376 | A | | 9/1998 | Viola et al. |
| 5,810,716 | A | | 9/1998 | Mukerjee et al. |
| 6,200,311 | B1 | | 3/2001 | Danek et al. |
| 6,487,439 | B1 | | 11/2002 | Skladnev et al. |
| 6,913,627 | B2 | | 7/2005 | Matsuda |
| 2002/0155199 | A1 | | 10/2002 | Heide et al. |
| 2008/0245801 | A1 | | 10/2008 | Ullman |

FOREIGN PATENT DOCUMENTS

| | | | | |
|---|---|---|---|---|
| DE | 29716262 | | | 12/1997 |
| DE | 20106836 | | | 9/2010 |
| EP | 0227213 | B1 | | 6/1990 |
| EP | 0448200 | A1 | | 9/1991 |
| EP | 520646 | B1 | | 12/1992 |
| EP | 0536906 | | | 4/1993 |
| EP | 0597606 | A1 | | 5/1994 |
| EP | 0520646 | B1 | | 12/1994 |
| EP | 0668836 | | | 8/1995 |
| EP | 0673855 | A2 | | 9/1995 |
| EP | 0941296 | | | 9/1999 |
| EP | 1055614 | A1 | | 11/2000 |
| EP | 1073593 | | | 2/2001 |
| EP | 0934887 | B1 | | 8/2002 |
| EP | 0965536 | B1 | | 8/2002 |
| EP | 1251079 | | | 10/2002 |
| EP | 1316513 | | | 6/2003 |
| GB | 2086834 | A | | 5/1982 |
| GB | 2086834 | A1 | | 5/1982 |
| WO | WO 91/07326 | | | 5/1991 |
| WO | WO 91/07326 | A1 | | 5/1991 |
| WO | WO 93/04945 | | | 3/1993 |
| WO | WO 93/15973 | | | 8/1993 |
| WO | WO 94/21533 | | | 9/1994 |
| WO | WO 95/03982 | | | 2/1995 |
| WO | WO 95/03982 | A2 | | 2/1995 |
| WO | WO 95/04688 | | | 2/1995 |
| WO | WO 95/04688 | A3 | | 2/1995 |
| WO | WO 95/05325 | | | 2/1995 |
| WO | WO 95/05326 | | | 2/1995 |
| WO | WO 95/05326 | A1 | | 2/1995 |
| WO | WO 9504688 | A2 | * | 2/1995 |
| WO | WO 9505325 | A1 | | 2/1995 |
| WO | WO 95/08493 | | | 3/1995 |
| WO | WO 95/08493 | A1 | | 3/1995 |
| WO | WO 95/30603 | | | 11/1995 |
| WO | WO 96/38351 | | | 12/1996 |
| WO | WO 97/00214 | | | 1/1997 |
| WO | WO 97/00214 | A2 | | 1/1997 |
| WO | WO 98/23701 | | | 6/1998 |
| WO | WO 99/54229 | | | 10/1999 |
| WO | WO 99/54229 | A1 | | 10/1999 |
| WO | WO 9954229 | A1 | * | 10/1999 |
| WO | WO 00/17065 | | | 3/2000 |
| WO | WO 00/69746 | | | 11/2000 |

* cited by examiner

INSERT FOR A PRESSURIZED CONTAINER OF LIQUID

The present invention pertains to an inner container, which can be added to a can that is under the pressure of a gas or to a pressurized container sealed in another manner ("Titanic" widget or wedge). This inner container is an insert, which can change the properties of the surrounding liquid when the pressurized container is opened, e.g., it promotes the formation of gas bubbles and/or releases an additive stored separately up to the point of opening of the pressurized container, so that this additive can still mix with the liquid before the liquid is poured out of the opened container. The insert according to the present invention is independent from the nature and the intended use of the surrounding liquid; however, it is also well suited especially for beverages that are filled, for example, in beverage cans.

Various inserts, which change the properties of a beverage at the moment at which the consumer opens the package, are known in the beverage industry. Thus, it has been known for a long time that inner containers, which can be filled with gaseous or liquid nitrogen or another gas before the can is sealed, can be used in cans intended for storing especially carbonated beverages and above all beer. These inner containers shall ensure, for example, that foaming beverages such as beer will develop a beautiful, stable head of froth on opening the can, or they may be provided for mixing with the beverage an ingredient stored separately from the beverage in the can at the time of opening the can. The first example is known to the person skilled in the art under the name "widget," the second under the name "wedge" or the trademark "FreshCan."

The principal feature common to these active inserts is, as a rule, that they are "charged" with the pressure that builds up in the head space of the packaging after the packaging is sealed. They are then activated by the abruptly occurring pressure drop during the opening of the beverage container and the pressure difference developing at that time between a gas space in their interior and their environment. To achieve this, their interior usually communicates with the liquid surrounding them such that the gas present in the inner container in the state of the filled, sealed can cannot escape into the surrounding liquid. Many suggestions have been made for this in the state of the art. Thus, the inner containers may have, for example, at least one and especially two openings with only a small diameter which is selected to be such that the surface tension of the liquid prevents gas bubbles from escaping in the filled and sealed state of the container. This effect is known as the so-called "gas bubble point effect." Gas containers with only one such opening are described, for example, in EP 448 200 A1 and in EP 520 646 A1, and those with two such openings are described in WO 95/08493. Openings with diameters dimensioned in this manner will hereinafter also be called openings with a reduced diameter.

It has been suggested both to provide the inserts floatingly on or in the liquid and to lock them in the container. According to a suggestion in WO 95/08493, a widget provided with two openings with a reduced diameter can be fastened on the bottom of a beverage can. WO 91/07326 suggests, among other things, that the gas-pressurized container shall have flexible arms with flanges, which fix the gas-pressurized container in a preset position in an upper or middle area of the container by press fit. It is suggested in WO 95/05325 that a gas-pressurized container be provided, which floats on the liquid.

To ensure that all such inserts can optimally assume their function, they must meet a plurality of conditions: At the time of the sealing of the outer container as well as for some time thereafter, the gas space of the insert should communicate with the gas space that is formed during the sealing of the outer container above the liquid level of the outer container ("head space"). Pressure equalization is thus brought about between the two gaseous compartments—and consequently a pressure charging of the insert—without part of the volume of the insert becoming filled with liquid and without the quantity of the desired effect thus being reduced as a consequence of the contraction of the gas in the insert. This is frequently brought about by providing the opening or one opening with a reduced diameter relatively far at the bottom of the insert and fixing the insert on the bottom of the liquid container. After filling and sealing, the container is then turned upside down until the pressure equalization mentioned takes place. However, since there is frequently a risk that a certain quantity of liquid will nevertheless penetrate, the geometry of the insert must prevent this liquid, when the container is again returned into its original position intended for opening, from flowing into an area that covers the opening and thus representing a barrier for the later discharge of gas, as this is suggested, for example, in EP 520 646, or a second opening, likewise with reduced external dimensions, which is arranged in the upper area of the widget, is provided. What is awkward with such inserts is not only the additional step of turning upside down after sealing, but also and especially the fact that the insert must be fastened to the inner bottom of the can before the can is filled. This is very complicated not only technically but logistically as well. If it is fastened with an adhesive, it must, in addition, be ensured that this is toxicologically harmless, tasteless and also has long-term stability against the surrounding liquid.

Floating inserts must be designed such that when the beverage container is opened, the gas must not escape through the opening in the insert that connects the gas space above the beverage level with the gas space in the insert, because the effect would "fizzle out" in such a case. Therefore, at least this opening must be designed as a valve, which permits only the entry, but not the escape of gas. Furthermore, such widgets must have a lower opening submerged in the liquid, through which the gas can again escape on opening the beverage container. Such widgets are described, for example, in WO 95/05326 and in EP 1 055 614 A1. However, this principle works only if even small quantities of liquid are prevented with certainty from entering the gas-pressurized container. In addition, the effect thus achieved is only moderate because the gas must escape downward at the moment of the pressure drop when the outer liquid container is opened. This also entails the risk that the widget will rotate in the liquid during the opening of the can until the gas outlet ceases to be submerged in the liquid.

An alternative is provided in WO 97/00214, whose floating widget requires an orienting device, which inevitably imparts to it a given orientation, and in which a plurality of passage channels ensure that gas can enter the widget from the gas space located in the liquid container above the liquid level and can again escape downward during the opening of the liquid container and the pressure drop associated therewith. This orientation aid notwithstanding, this widget may unintentionally rotate and, in addition, its construction is excessively complicated.

Besides wedges installed in a fixed position in the liquid container and widgets that float on top of the liquid, suggestions have also been made already to use widgets that shall be able to first float on the liquid, rotate and sink after some time. Thus, WO 95/04688 discloses a capsule with two chambers, which has a first opening, which is submerged in the liquid, communicates with the upper chamber in the capsule via a tube or the like and through which liquid can enter. When this liquid enters, gas is displaced from the upper chamber (ballast chamber), and this gas passes over into the lower chamber (pressure chamber) via a second opening, which must be protected from filling with this liquid. This [second chamber] communicates via another tube, which likewise passes through the partition between the two openings, with a discharge opening on the top side of the capsule, which is in contact with the gas space of the liquid container. A similarly complicated suggestion is found in WO 95/03982. Since the pressure chamber and the ballast chamber communicate with one another via a fine pressure equalization tube in these widgets, the ballast chamber must not have a direct opening to the outside on its outer side, because liquid could otherwise enter the pressure chamber.

The large amount of state of the art on this subject shows that a large number of suggestions have been presented to solve the above problem, but they are imperfect or are associated with excessively great technical efforts.

The so-called wedges use the same principle as the widgets, but this is used additionally or also alternatively to store an ingredient separately during the storage of the liquid in the liquid container, doing so in such a way that it automatically mixes with the liquid surrounding the inner container when the container is opened and a pressure drop develops in the process. Thus, WO 99/54229 discloses an inner container with two chambers, one chamber of which has an opening with a reduced diameter, which maintains a communication between the interior of this chamber and the external environment, so that the overpressure of gas prevailing in a beverage container can be admitted to this chamber as it was described above for the widgets. This chamber is separated by an inner wall, which is impermeable to gas and liquid, from a second chamber, which is intended for storing a substance, The latter, for example, a liquid or solid taste-bearing substance or a minor nutrient, shall mix with the surrounding beverage on opening the beverage can. The container having the two chambers is composed of an upper part and a lower part in such a way that the pressure difference occurring when the beverage can is opened and the pressure drop developing in the process generates forces that are stronger than the connection between the two parts, and the chamber accommodating the additive is "burst," so that the substance it contains flows into the surrounding beverage liquid.

The use of wedges is associated with difficulties similar to those described above for the widgets. Bonding to the bottom before filling the beverage liquid requires a considerable effort and the use of toxicologically harmless, odorless and tasteless adhesives which are stable during storage and when exposed to the beverage. If they are designed as floating wedges, the problems described above will be encountered as well.

The object of the present invention is to provide an insert for containers containing gas-pressurized liquids, especially beverages, which said insert has, independently from its intended use and consequently independently from how its interior is designed, a gas compartment, which reliably communicates with the gas space formed in the liquid container after the sealing via an opening with a reduced diameter upon the sealing of the liquid container, while the said opening shall be surrounded by liquid at the time of opening the liquid container, which happens later, such that the pressure difference developing abruptly during the opening can exert the desired effect. This insert can be provided for improving the formation of gas bubbles and/or to store a second ingredient, but for other purposes as well.

This object is accomplished by an insert that has a body that can be activated by pressure and has at least one cavity, in conjunction with a positioning device, wherein (a) the body that can be activated by pressure has at least one opening with a reduced diameter, which connects the cavity with the environment of the insert and is located in a location that lies above the level of the liquid when the insert is floating, and (b) the positioning device comprises a floating body, which has a small opening, which is submerged in the liquid when the insert is placed on the latter, at least one ventilation opening, which communicates directly with the external environment of the insert, and a minimum volume, which ensures that the insert will sink into the liquid when filled with liquid.

Figure 2:
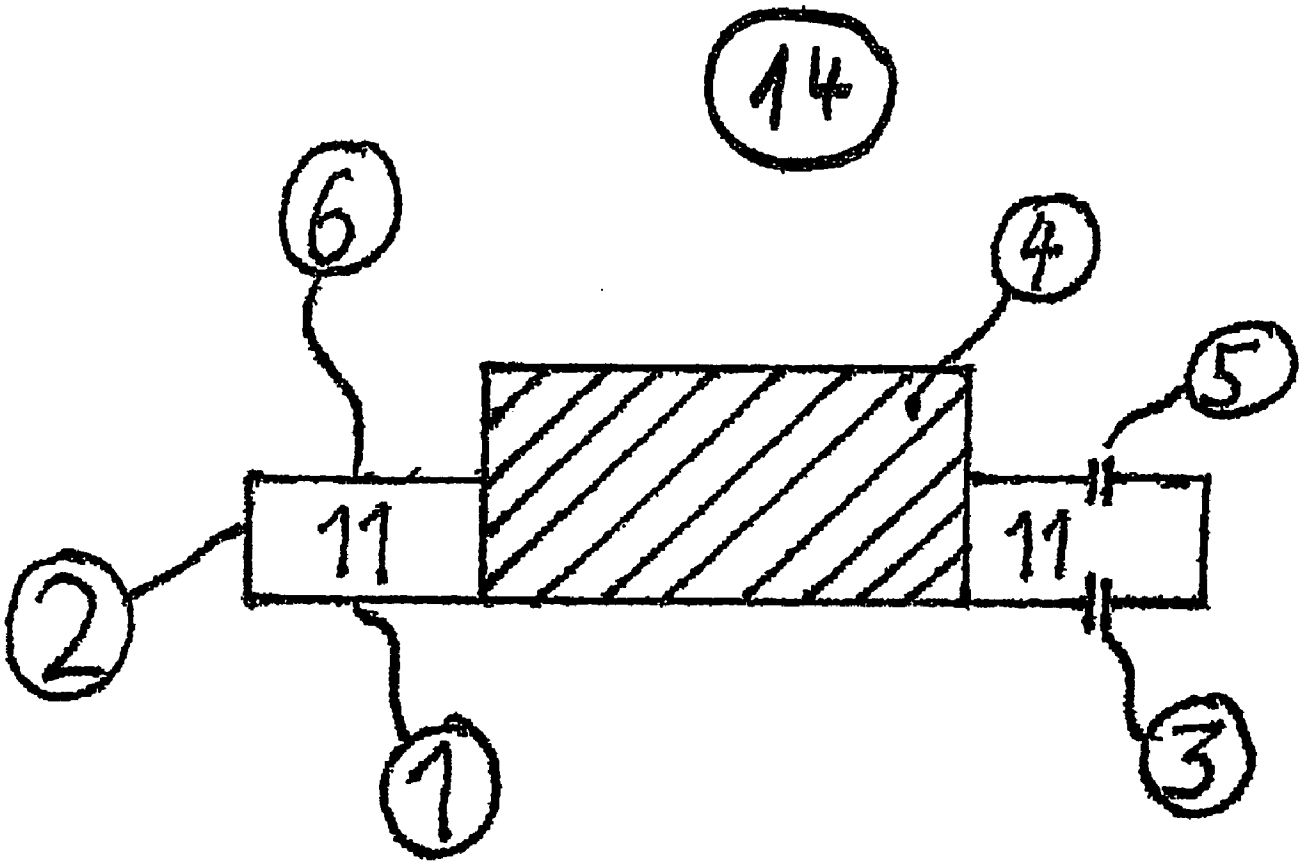
Figure 3:
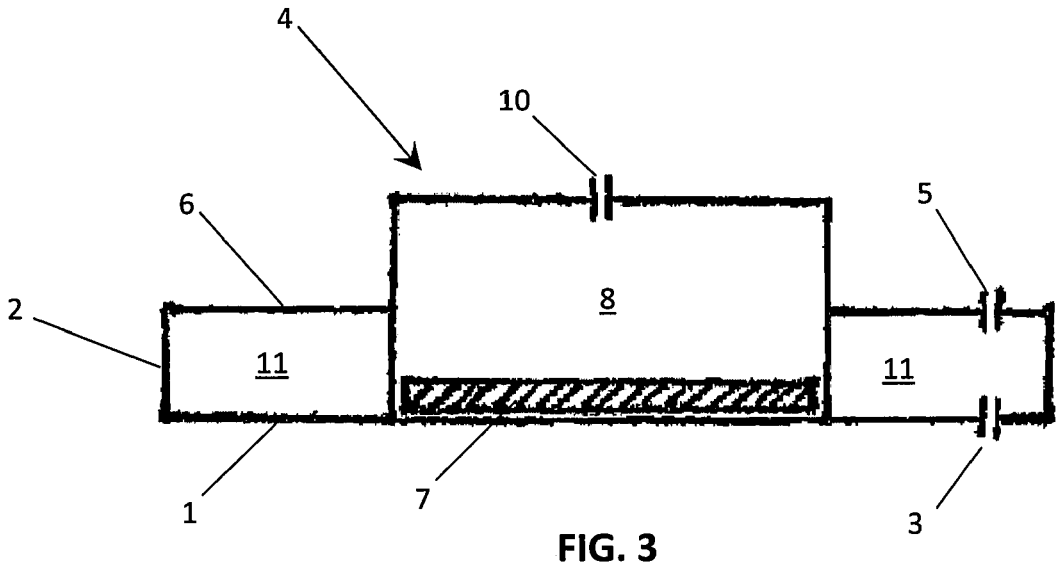
Figure 4:
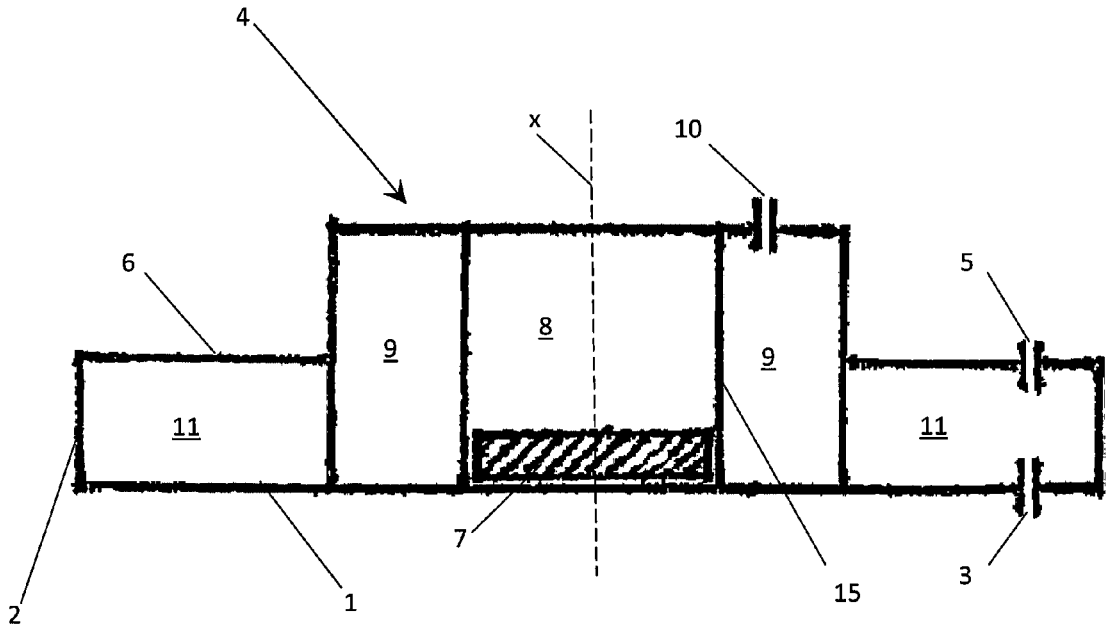
Figure 5:
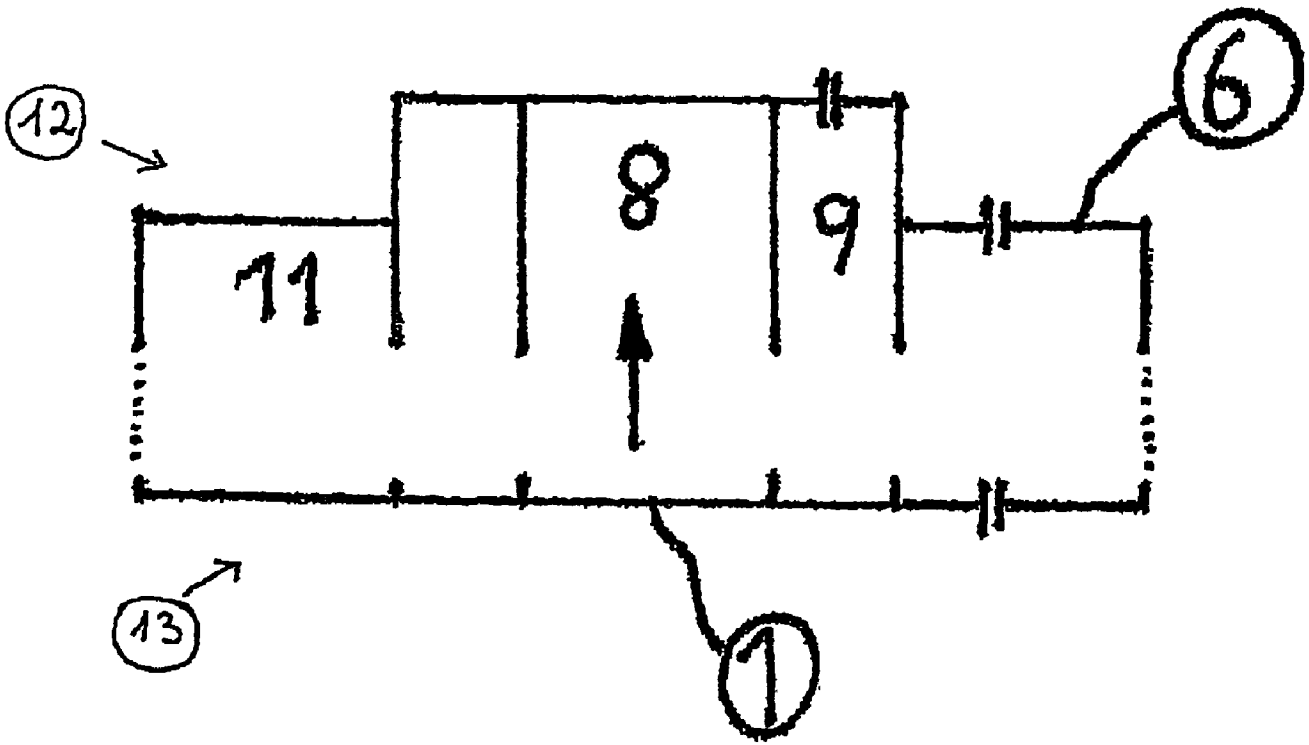

The attached figures show specific embodiments of the insert according to the present invention, namely, FIG. 1 shows an insert with a floating body in the form of a boat, FIG. 2 shows an insert with a floating body in the form of a covered boat ("submarine"), FIG. 3 shows an insert whose body, which can be activated by liquid, is a single-chamber widget, into which an additional weight was introduced, FIG. 4 shows an insert whose body, which can be activated by pressure, is a two-chamber wedge, into which an additional weight was introduced, and FIG. 5 shows a specific possibility of how an insert according to FIG. 4 can be composed of two components, which separate as a consequence of the pressure drop during the opening of the beverage container and release the contents of the product chamber.

The term "small opening" does not mean the same as the term "opening with a reduced diameter." The small opening is rather an opening that permits liquid to pass through it, but this passage shall be so slow thanks to the selection of the small dimensions that the liquid will flood the floating body in a matter of minutes or even more slowly. The person skilled in the art can easily determine the dimensions of this opening on the basis of his knowledge and simple experiments; in addition, suitable parameters are available to him based on the example. Thus, the dimensions are preferably in the range of about 0.5 mm to 2 mm and preferably 1-1.5 mm for aqueous liquids and hydrophobic materials of the floating body such as polypropylene.

Besides the above-mentioned openings, the insert according to the present invention has (at least) one ventilation opening. The term "ventilation opening" implies that this opening of the floating body enables gas to escape. It is therefore preferably located above the level of liquid when the insert according to the present invention is placed on the liquid and it is always above the small opening, and it ensures in a simple manner that when the floating body is flooded, the gas contained in it can escape. This ventilation opening may be designed as a completely free opening. It may be formed, for example, by the floating body having no cover or wall on its top side at all. However, the floating body may have, instead, one or more openings in one or more areas at a suitable level, but it may otherwise be closed. The size of this opening/these openings is naturally completely noncritical. It may be the same as that of the small opening explained above, but it may also be larger or smaller.

The term "body that can be activated by pressure and has at least one cavity" shall comprise all the bodies that have, in the manner of a widget or wedge, at least one cavity, which communicates with the environment via (at least) one opening with a reduced diameter as was described above. It shall be pointed out in particular that the suitable bodies that can be activated by pressure comprise all the bodies that possess the necessary properties, independently from the intended purpose and also independently from whether the liquid to be sealed in the outer liquid container is intended for consumption or is used for other purposes. However, the present invention is suitable above all for packagings for beverages such as cans and here for the embodiment of widgets having one or two openings with a reduced diameter with at least one hollow interior space as well as for wedges, which have at least two chambers, one of which is hollow and ensures pressure equalization via one or more openings with a reduced diameter, and the second of which is used to accommodate an additional substance such as a minor nutrient or flavoring agent.

The insert according to the present invention is thrown into the liquid container before or after it is filled and it immediately assumes a floating position because of the inherent buoyant force of the floating body. The liquid container is sealed after filling, optionally under pressure. The pressure building up in the gas space above the level of the liquid is equalized with the cavity in the body that can be activated by pressure via the opening with a reduced diameter. The openings with a reduced diameter that are known in the state of the art permit the pressure charging of suitable cavities within a period of usually about 10 sec to 300 sec, and this period is, of course, also needed by the inserts according to the present invention in case of the same construction. At the same time, liquid enters the floating body via the small opening of the insert according to the present invention, which is located under the level of liquid. This opening is dimensioned such that the floating body is filled completely only after the end of the period that is needed for the pressure charging and thus causes the insert to sink. If the liquid container is then opened later, the insert is located on the bottom of the liquid container, so that the opening with a reduced diameter is submerged in the liquid and can exert its effect to the full extent.

The floating body is preferably arranged outside the body that can be activated by pressure.

In an especially preferred embodiment, the floating body has the shape of a boat, which carries the body that can be activated by pressure and has at least one cavity. In this embodiment, the insert is, of course, introduced, e.g., thrown into the liquid container only after the liquid has been filled in. The boat has a bottom as well as a circumferential side wall, which is designed such that the capacity of the boat has the necessary minimum volume according to the present invention with the pressure-activated body located in it. The body that can be activated by pressure can be inserted into the floating body in the fully formed form. As an alternative, parts of the body that can be activated by pressure may at the same time be parts of the boat. For example, the bottom of the body that can be activated by pressure may be part of the bottom of the boat, which extends farther to the outside and is surrounded all around by the said side wall. Instead of or in addition to this, the body that can be activated by pressure may also have a part of the side wall in common with that of the boat. It must, of course, be ensured in this embodiment, which cannot be rotationally symmetrical, that the weight distribution does not lead to an oblique position of the insert when it is placed on the liquid. Finally, it would also be possible, for example, that the body that can be activated by pressure extends in an annular pattern at the side wall of the boat, so that its outer side wall is also the wall of the boat at the same time.

In another preferred embodiment of the present invention, the floating body has the shape of a closed cavity. For example, the boat, as it was described above, may be provided with a cover. This embodiment has the advantage that the insert can be introduced into the liquid container at any desired time and that it can be thrown onto the liquid when it is introduced later without the risk that the floating body would be flooded before time in case of an accidental tilting. The cover also has one or more openings in this embodiment, which may be, e.g., small openings, in order to make possible the escape of gas from the floating body being filled during sinking.

The one or more small opening(s) may be located on the bottom and/or in the side wall of the floating body in all embodiments. Only one of them has to be arranged under any circumstances such that it is located under the level of the liquid when the insert is floating on the liquid. Sinking of the insert can be accelerated with an additional opening (with additional openings) located farther above when the floating body is already partially flooded.

The materials for the body that can be activated by pressure, the floating body and optionally the materials used as an additive for mixing with the liquid, on the one hand, and the cavities present, on the other hand, are selected in a suitable manner such that the insert will float reliably when placed on the liquid, and, by contrast, it will sink reliably after the floating body is filled. To compensate possible buoyant forces, a weight having the force G may be provided. These buoyant forces F are, e.g., $$F_{density}=V_{material}*(\rho_{liquid}-\rho_{material})*g$$

$$F_{Archimedes,1}=V_{floating\ body}*\rho_{liquid}*g$$

$$F_{Archimedes,2}=V_{body}*\rho_{liquid}-\rho_{body})*g$$

The weight G must be such that $$G > F_{density} + F_{Archimedes,2} \quad \text{Equation 1}$$

$$G < F_{density} + F_{Archimedes,1} + F_{Archimedes,2} \quad \text{Equation 2}$$

This means that the insert, i.e., the entire object, floats when the floating body is not flooded, but it sinks when it is flooded. What is particularly important in the consideration of the physical conditions is the density $\rho_{body}$ and the volume $V_{body}$ of the body that can be activated by pressure, which are therefore to be taken primarily into account. This mean density may be greatly affected, for example, by the density of the additional substance, with which the second chamber of a widget may be filled, and by the size of the cavity or cavities in the body that can be activated by pressure.

If the above inequations are applied to the widgets or wedges known in the state of the art, it is seen that these cannot meet the above conditions, because $V_{floating\ body}=0$ applies to them. Consequently, they do not meet the constraints for floating and sinking according to Equations 1 and 2, so that they cannot be positioned in a pressure- and time-determined manner.

As was mentioned above, the formation of gas bubbles can be improved with the present invention in a liquid that is sealed under gas pressure in a container when that container is opened. This happens with the use of the following steps:

(a) Filling of the open container with the liquid, (b) introduction of an insert according to the present invention into the container before or after the liquid is filled in, (c) sealing of the liquid container, optionally with the admission of a pressure into the gas space above the liquid in the liquid container such that an overpressure will build up within the liquid container compared to the ambient pressure after the sealing, (d) a slow pressure equalization is made possible between the interior of the at least one cavity in the insert and the gas space above the level of liquid in the liquid container, (e) the insert is allowed to sink to the bottom of the liquid container, (f) opening of an opening intended for this purpose in the liquid container, as a result of which an abrupt pressure drop to ambient pressure takes place in the liquid container, and (g) gas bubbles are allowed to leave the cavity of the body that can be activated by pressure through the opening with a reduced diameter.

In addition, the present invention can be used to mix a substance stored separately in a container with a liquid contained in the container when the container is opened. This occurs due to the following steps:

(a) Filling of the additional cavity (8) of an insert according to the present invention, which cavity is intended for this purpose, with the solid or liquid substance, (b) filling of the open container with liquid, (c) introduction of the insert into the container before or after the liquid is filled in, (d) sealing of the liquid container, optionally with the admission of pressure into the gas space above the liquid in the liquid container, such that an overpressure will build up within the liquid container compared to the ambient pressure after sealing, (e) a slow pressure equalization is made possible between the interior of the at least one cavity in the insert and the gas space above the level of liquid in the liquid container, (f) the insert is allowed to sink to the bottom of the liquid container, (g) an opening intended for this purpose is opened in the liquid container, as a result of which an abrupt pressure drop to ambient pressure takes place in the liquid container, and (h) the wall between the cavities (8) and (9) of the insert is allowed to open due to the overpressure generated in the cavity (9) during the opening of the liquid container and the release of the solid or liquid substance contained therein into the surrounding liquid.

The present invention shall be explained in greater detail below on the basis of figures and exemplary embodiments.

Example 1

An insert has a body 4 that can be activated by pressure in the form of a widget, e.g., one shown in FIG. 3, which is arranged in a boat-shaped floating body as is shown in FIG. 1 or in a submarine-shaped floating body as is shown in FIG. 2. The floating body has a bottom 1, which is integrally connected with the bottom of the body that can be activated by pressure, as well as a wall 2, and it is optionally a floating body 11 with a cover 6. The figures are to be read in this example such that the components are rotationally symmetrical in relation to a vertical axis x. It shall, however, be pointed out that the geometry of the insert according to the present invention may, of course, also be different, e.g., with a square, rectangular or polygonal horizontal projection, or also asymmetrical in relation to the axis x.

The body that can be activated by pressure has a cavity with an inner volume of about 10 mL. It was made of polypropylene, which has a density of about 850 kg/m$^3$. The reduced diameter of the opening 10 is approx. 0.25 mm, which causes the widget to be completely charged with the prevailing pressure after about 30 sec when it is used in a beverage can, e.g., a beer can.

The floating body has a bottom diameter of about 40-50 mm and a height of about 10-20 mm. Thus, minus the widget located in it, it has a net volume of about 22 mL. Its openings 3 and optionally 5 are small openings in the sense of the present invention: They have a diameter of approx. 1.5 mm. When the insert is placed on water, the floating body is flooded in about one minute.

A weight 7 of approx. 17 g with a force of 170 mN is arranged in the widget to ensure that the insert will sink. The following equations will assume the following form for water with a density of approx. 1,000 kg/m$^3$ and air as the surrounding gas with a density of approx. 0:

$$F_{density}=4*10^{-6}\ m^3*(1000-850)\ kg/m^3*9.81\ m/sec^2$$

$$F_{Archimedes,1}=22*10^{-6}\ m^3*1000\ kg/m^3*9.81\ m/sec^2$$

$$F_{Archimedes,2}=10*10^{-6}\ m^3*(1000-0)\ kg/m^3*9.81\ m/sec^2.$$

Thus, the decisive buoyant forces will be:

$$F_{density}=10\ mN$$

$$F_{Archimedes,1}=215\ mN,\ \text{and}$$

$$F_{Archimedes,2}=100\ mN.$$

Thus, the constraints of Equations 1 and 2 are:

$$170\ mN > 10\ mN + 100\ mN \qquad \text{[Equation 1]}$$

$$170\ mN < 10\ mN + 100\ mN + 215\ mN \qquad \text{[Equation 2]}$$

Thus, an insert with the dimensions and properties according to this example meets the necessary conditions and can be used according to the present invention as an insert with time-determined positioning. The weight is selected to be such that the inequations are satisfied generously. Minor secondary effects, such as the surface tension of the water, cannot therefore have any effect on the sinking behavior.

Example 2

FIG. 4 shows an insert whose body that can be activated by pressure is a wedge with a gas chamber 9, which communicates with the environment via an opening with a reduced diameter, and with a product chamber. To increase the weight, a weight 7 is introduced into the product chamber. The wedge is surrounded by a covered floating body ("submarine" floating body) 11, which has a first small opening in its bottom and has a second such opening in its cover for the purpose of pressure equalization. FIG. 5 shows an example of how such an insert can be made of only two components (without taking the weight into consideration). The bottom of the body that can be activated by pressure and the bottom of the surrounding floating body are made integrally in one piece, and the lower part of all side walls, the partition 15 between the gas chamber 9 and the product chamber 8 in the wedge, the outer wall of the wedge and the outer wall of the floating body is made integrally in one piece with this bottom, while the upper parts of all these side walls are made in one piece with the top side of the wedge and with the cover of the floating body. The connection of the side walls in the assembled insert may be, e.g., a snap connection, a frictionally engaged connection or a connection consisting of an adhesive that is not very strong, which is burst by the abruptly occurring pressure difference between the gas space 9 and the environment as well as the product container during the opening of the liquid container. Details of this can also be found in the specification of WO 99/54229, in which two-chamber wedges of the type being used here are generally described The embodiments of this example may also be rotationally symmetrical, but they do not have to be.

The invention claimed is:

1. An insert adapted for addition to a gas-pressurized liquid in a liquid container, the liquid container also having a headspace adjacent to the gas-pressurized liquid, comprising:

a body that is activated by pressure, having a perimeter and at least one first cavity, said body having an opening that allows said at least one first cavity to communicate with said headspace; and a positioning device interconnected to at least a portion of said perimeter of said body and arranged outside said perimeter of said body, said positioning device having at least one second cavity, said positioning device further comprising:

an opening arranged in a lower surface of said positioning device, which is in communication with said at least one second cavity, said opening being submerged in the gas-pressurized liquid when said insert is floating on the gas-pressurized liquid, a ventilation opening arranged in an upper surface of said positioning device, which is in communication with said at least one second cavity, that directly communicates with the headspace, said lower surface of said positioning device being coplanar with a lower surface of said body, wherein said at least one second cavity ensures that said insert will sink into the gas-pressurized liquid when said at least one second cavity is filled with the gas-pressurized liquid, and wherein said at least one first cavity is maintained in an upright position for communicating with a headspace in an un-submerged state and for releasing contents when said insert is submerged in the gas-pressurized liquid.

2. The insert of claim 1, wherein a bottom surface of said body and said lower surface of said positioning device form an integral unit.

3. The insert of claim 1, wherein said at least one first cavity of said body is comprised of a primary cavity having an opening for communication with the headspace an auxiliary cavity that is adapted to accommodate a solid or liquid substance, said primary cavity and said auxiliary cavity being separated by a partition.

4. The insert of claim 3, wherein said partition between said primary cavity and said auxiliary cavity is a circumferential wall, which completely surrounds the said auxiliary cavity.

5. The insert of claim 4, wherein the said auxiliary cavity has the shape of a cylinder that is symmetrical in relation to an axis (x), and said primary cavity has the shape of a cylindrical sleeve.

6. The insert of claim 1, wherein said body is arranged centrically in said positioning device.

7. The insert of claim 6, wherein said body and the said positioning device are designed as symmetrical bodies in relation to an axis (x).

8. The insert of claim 1, further comprising a weight positioned within said at least one first cavity of said body.

9. The insert of claim 8, wherein said weight is an integral part of the said body.

10. The insert of claim 1, wherein said insert is comprised of a bottom part, a cover part and a weight.

11. The insert of claim 10, wherein the said bottom part and the said cover part are connected via a snap connection or a frictionally engaged connection.

12. The insert of claim 10, wherein said bottom part and a cover part are connected with one another via side walls thereof.

13. The insert of claim 10, wherein said cover part includes a side wall that snappingly engages said bottom part.

14. The insert of claim 1, further comprising a liquid filled container, wherein the insert is introduced into the container before or after the open container is filled with the gas-pressurized liquid, and the gas-pressurized liquid container is sealed, such that an overpressure develops compared to the ambient pressure within the gas-pressurized liquid container after the sealing.

15. The insert of claim 14, wherein said overpressure is admitted into said headspace of the liquid container.

16. The insert of claim 14, wherein the liquid is a foaming beverage.

17. The insert of claim 3, wherein said auxiliary cavity is filled with the solid or liquid substance, the open container is filled with liquid, the insert is introduced into the container before or after the liquid is filled into the container, and the liquid container is sealed, such that an overpressure develops compared to the ambient pressure after the liquid container is sealed.

18. The insert of claim 17, wherein said overpressure is admitted into the headspace.

19. The insert of claim 17, wherein the liquid is beer and said solid or liquid substance is an aroma compound.

20. The insert of claim 17, wherein the liquid is an alcohol-free, carbonated beverage or a non-carbonated beverage, which was filled with the addition of liquid nitrogen, and said solid or liquid is an aroma compound.

* * * * *